US012201889B2

(12) United States Patent
Ouellet

(10) Patent No.: US 12,201,889 B2
(45) Date of Patent: Jan. 21, 2025

(54) HOCKEY GOALKEEPER LEG PAD

(71) Applicant: SPORT MASKA INC., Montreal (CA)

(72) Inventor: Francis Ouellet, Montréal (CA)

(73) Assignee: SPORT MASKA INC., St-Laurent (CA)

( * ) Notice: Subject to any disclaimer, the term of this patent is extended or adjusted under 35 U.S.C. 154(b) by 96 days.

(21) Appl. No.: 17/634,305

(22) PCT Filed: Aug. 14, 2020

(86) PCT No.: PCT/CA2020/051121

§ 371 (c)(1),
(2) Date: Feb. 10, 2022

(87) PCT Pub. No.: WO2021/026667

PCT Pub. Date: Feb. 18, 2021

(65) Prior Publication Data

US 2022/0339523 A1 Oct. 27, 2022

Related U.S. Application Data

(60) Provisional application No. 62/886,568, filed on Aug. 14, 2019.

(51) Int. Cl.

| | |
|---|---|
| ***A63B 71/12*** | (2006.01) |
| ***A41D 13/05*** | (2006.01) |
| ***A63B 102/24*** | (2015.01) |

(52) U.S. Cl.

CPC ..... *A63B 71/1225* (2013.01); *A41D 13/0543* (2013.01); *A63B 2071/125* (2013.01); *A63B 2071/1258* (2013.01); *A63B 2071/1283* (2013.01); *A63B 2102/24* (2015.10); *A63B 2209/10* (2013.01)

(58) Field of Classification Search

CPC ..... A63B 71/1225; A63B 2209/10; A63B 2071/1258; A63B 2102/24; A41D 13/0543

USPC ..... 2/22

See application file for complete search history.

(56) References Cited

U.S. PATENT DOCUMENTS

| | | | | |
|---|---|---|---|---|
| 9,381,421 | B2 | 7/2016 | Vaughn | |
| 2009/0320174 | A1* | 12/2009 | Turner | A41D 13/0506 2/69 |
| 2015/0033433 | A1* | 2/2015 | Mackey | A63B 71/1225 2/22 |
| 2019/0351311 | A1 | 11/2019 | Vaillancourt | |
| 2019/0351312 | A1 | 11/2019 | Mackey et al. | |

* cited by examiner

*Primary Examiner* — Bao-Thieu L Nguyen
(74) *Attorney, Agent, or Firm* — NORTON ROSE FULBRIGHT CANADA

(57) ABSTRACT

A hockey goalkeeper leg pad includes a core, a skin covering the core, a lateral leg flap and a medial leg flap defining a leg channel, and a lacing member. The lacing member includes lower tabs and upper tabs. The lower tabs and the upper tabs each defining apertures with a front inner surface of the skin covering the core, and the lower tabs and the upper tabs being attached to the front inner surface at lateral outer ends thereof. The upper tabs are laterally offset outward of the lower tabs relative to a longitudinal centerline of the lacing member. A lace extends through the lower apertures and the upper apertures, as well as through the core to secure the core to the lacing member.

24 Claims, 4 Drawing Sheets

HOCKEY GOALKEEPER LEG PAD

This application is a U.S. National Application filed under 35 U.S.C. 371 of International Application No. PCT/CA2020/051121 filed Aug. 14, 2020, which claims priority on U.S. Application No. 62/886,568 filed Aug. 14, 2019, the entire contents of each of which are incorporated herein by reference.

TECHNICAL FIELD

The application relates to sporting equipment, and more particularly to leg pads for a hockey goalkeeper.

BACKGROUND

Ice hockey players generally wear protective leg equipment. Ice hockey goalkeepers (goaltenders) wear a specific type of leg pad, typically referred to simply as "goalie pads". Improvements in such goalie leg pads are continuously sought, particularly in order to improve their comfort and the mobility of the goalkeeper.

SUMMARY

In one aspect, there is provided a hockey goalkeeper leg pad, comprising: a core; a skin covering the core at least in part and having a front outer surface, a front inner surface, and a rear outer surface; a lateral leg flap and a medial leg flap attached to the rear outer surface of the skin and defining a leg channel between the lateral and medial leg flaps; a lacing member including: lower tabs defining lower apertures with the front inner surface, the lower tabs being attached to a lower portion of the front inner surface, and upper tabs defining upper apertures with the front inner surface, the upper tabs being attached to an upper portion of the front inner surface, the upper tabs being laterally offset outward of the lower tabs relative to a longitudinal centerline of the lacing member; a lace extending through the lower apertures and through the core and securing the core to the lacing member; and a lace extending through the upper apertures and through the core and securing the core to the lacing member.

The hockey goalkeeper leg pad as described herein may further include, in whole or in part, and in any combination, one or more of the following additional features.

In some embodiments, the hockey goalkeeper leg pad comprises a strap extendable across the leg channel to releasably secure a leg in the leg channel after the leg is received in the leg channel and wherein: the lace extending through the lower apertures and the lace extending through the upper apertures are one and the same lace, the lower tabs extend outward of a lower portion of the lacing member, and the upper tabs extend outward of an upper portion of the lacing member.

In some embodiments, each of the lower tabs is attached to the front inner surface of the skin at a location that is outward of a part of the lace passing through the aperture defined by that lower tab, relative to the longitudinal centerline of the lacing member; and each of the upper tabs is attached to the front inner surface of the skin at a location that is outward of a part of the lace passing through the aperture defined by that upper tab, relative to the longitudinal centerline of the lacing member.

In some embodiments, the upper tabs include upper tabs on each side of the longitudinal centerline.

In some embodiments, the lacing member defines a cut-out therein, and the cut-out is positioned between the upper tabs on one side of the longitudinal centerline and the upper tabs on the other side of the longitudinal centerline.

In some embodiments, the lacing member extends from a lower portion of the skin to an upper portion of the skin.

In some embodiments, the lower portion of the skin covers a lower portion of the core, and the lower portion of the core is adjacent a skate on a foot of the leg when the hockey goalkeeper leg pad is in use.

In some embodiments, the hockey goalkeeper comprises a knee pad disposed on the rear outer surface above the medial leg flap, the knee pad being attached to the rear outer surface by the lace extending through the upper apertures.

In some embodiments, some of the upper tabs are disposed behind an interface between the knee pad and the rear outer surface and at least some parts of the lace passing through the some of the upper tabs are parallel to the interface.

In some embodiments, the at least some parts of the lace pass through a part of the knee pad to attach the knee pad to the skin and the core when the lace is tightened when the hockey goalkeeper leg pad is assembled.

In some embodiments, the lace extending through the lower apertures and the lace extending through the upper apertures are one and the same lace, and the one and the same lace passes through the knee pad and attaches the knee pad to the rear outer surface of the skin and the core.

In some embodiments, the one and the same lace: passes through the rear outer surface of the skin at locations that are inward of the lateral leg flap and the medial leg flap, and secures both upper and lower portions of the rear outer surface of the skin to respective upper and lower portions of the core.

In some embodiments, the one and the same lace passes through the rear outer surface of the skin at locations that are aligned with an interface between the lateral leg flap and the rear outer surface, and at locations that are aligned with an interface between the medial leg flap and the rear outer surface.

In some embodiments, the one and the same lace is in its entirety disposed behind the front outer surface and the front inner surface of the skin.

In another aspect, there is provided a hockey goalkeeper leg pad, comprising: a core; a skin covering the core at least in part and having a front outer surface, a front inner surface, and a rear outer surface; a lateral leg flap and a medial leg flap attached to the rear outer surface of the skin and defining a leg channel between the lateral leg flap and the medial leg flap; and a lacing member including a central portion attached to the front inner surface and tabs extending outward of the central portion relative to a longitudinal centerline of the lacing member, the tabs and the front inner surface of the skin defining apertures between the tabs and the front inner surface.

The hockey goalkeeper leg pad as described herein may further include, in whole or in part, and in any combination, one or more of the following additional features.

In some embodiments, the hockey goalkeeper leg pad includes a lace extending through the apertures, the core, and the rear outer surface and securing the front inner surface and the rear outer surface to the core; the tabs are attached to the front inner surface of the skin at locations that are outward of the corresponding parts of the lace relative to the longitudinal centerline of the lacing member; and the tabs include: lower tabs extending outward of a lower portion of the central portion of the lacing member, and upper tabs extending outward of an upper portion of the central portion of the lacing member, the upper tabs extending outward of the lower tabs relative to the longitudinal centerline of the lacing member.

In some embodiments, the lacing member extends from a lower portion of the skin to an upper portion of the skin and the central portion of the lacing member defines a cut-out therein.

In some embodiments, the hockey goalkeeper comprises a knee pad attached to the rear outer surface of the skin by the lace at a location above the medial leg flap.

In some embodiments, some of the upper tabs are disposed behind an interface between the knee pad and the rear outer surface, and a portion of the lace passes through the some of the upper tabs, the interface, and the knee pad, to attach an inner edge of the knee pad to the rear outer surface of the skin.

In some embodiments, the lace: a) attaches the knee pad to both the skin and the core, b) attaches both the front inner surface and the rear inner surface of the skin to the core, and c) is in its entirety disposed behind both the front outer surface and the front inner surface of the skin.

BRIEF DESCRIPTION OF THE DRAWINGS

Reference is now made to the accompanying figures in which.

DETAILED DESCRIPTION

Figure 1:
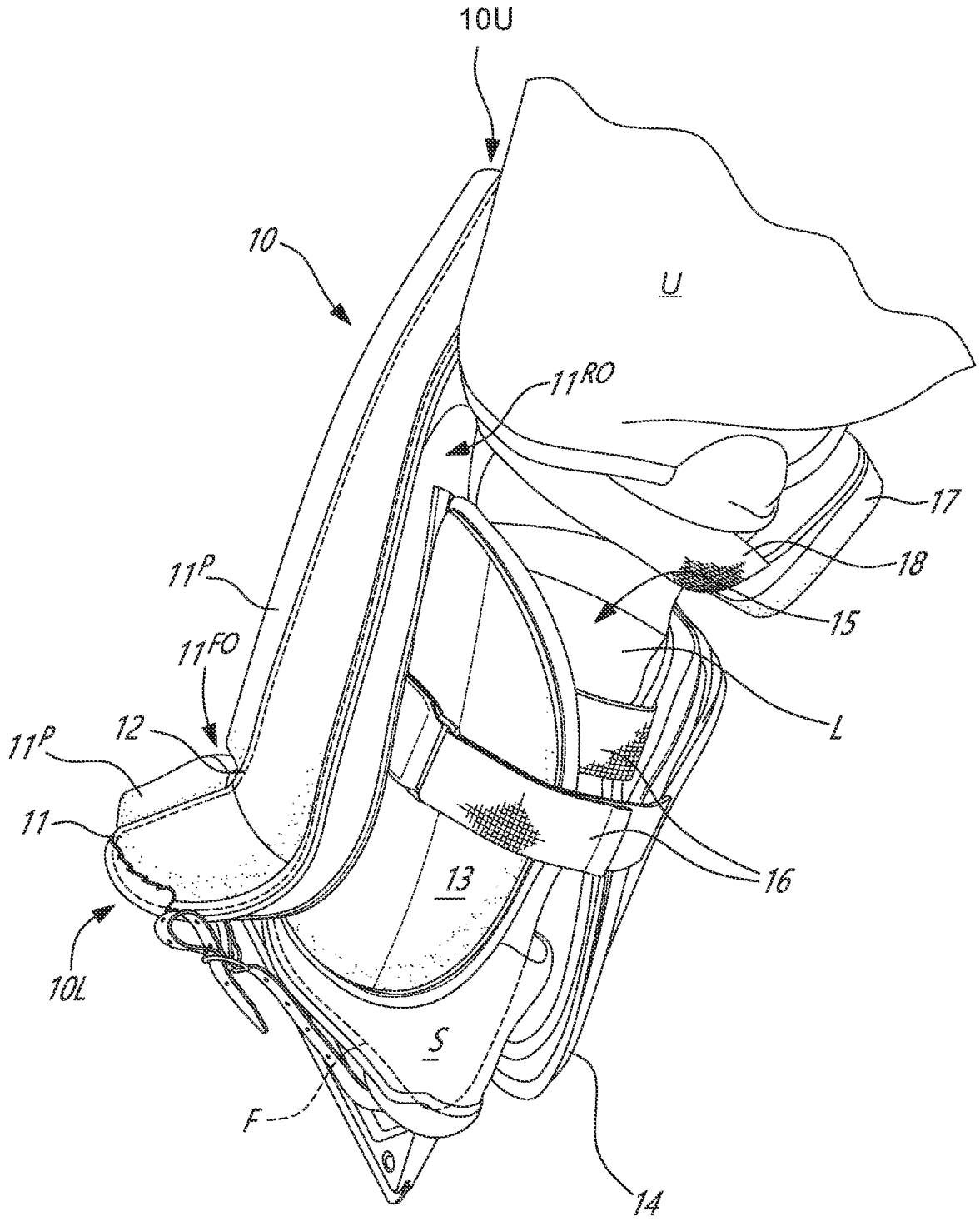
FIG. 1 is a rear perspective view of a hockey goalkeeper leg pad, worn on a leg of a goalkeeper, in accordance with an embodiment of the present disclosure.

FIG. 1 illustrates a hockey goalkeeper leg pad 10 that may be used to protect at least a portion of a leg (L) of a goalkeeper during sporting events, such as ice hockey for example, from hazards such as a hockey puck shot toward the leg (L) of the goalkeeper wearing the hockey goalkeeper leg pad 10. The hockey goalkeeper leg pad 10 (also referred to herein simply as "leg pad 10") can have different sizes and shapes and is adapted to cover, or substantially cover, the leg (L). In the depicted embodiment, the leg pad 10 is of a type generally known as a "goalie pad" or a "goalkeeper's pad" such as those worn by ice hockey goalkeepers. The leg pad 10 extends between an upper end 10U and a lower end 10L thereof.

When the leg pad 10 is worn by the user (U) (also referred to simply as "in use"), it extends along the leg (L) from the skate (S) worn on the leg (L) to a thigh of the user (U). In the embodiment shown, the leg pad 10 is adapted to be worn on the left leg (L) of the user (U). A corresponding leg pad, which may be a mirror image of the leg pad 10, may be worn on the right leg of the user (U). Although the technology of the present application is described with respect to hockey goalkeeper leg pads 10, the technology may also be applied to other types of protective accessories and/or protective clothing articles.

The leg pad 10 includes a skin 11. The skin 11 in this embodiment has a generally rectangular shape. In other embodiments, the skin 11 may have other shapes, depending on each particular application for which the leg pad 10 may be designed for example. As shown in FIG. 1, in this embodiment, the skin 11 includes forward-facing protrusions 11P that are part of the front outer surface 11FO and which house shock-absorbing padding (not shown). In some embodiments, a different configuration of the forward-facing protrusions 11P may be used. In some embodiments, the forward-facing protrusions 11P and the corresponding shock-absorbing padding may be omitted.

Still referring to FIG. 1, the skin 11 further includes a front outer surface 11FO that is oriented to receive and absorb impacts during use, a front inner surface 11FI (FIG. 4) opposite to the front outer surface 11FO, a rear inner surface 11RI, and a rear outer surface 11RO opposed to the front outer surface 11FO and opposite the rear inner surface 11RI. The rear outer surface 11RO faces and contacts the leg (L) when the leg pad 10 is in use. In this embodiment, these surfaces 11FO, 11FI, 11RO extend from the upper end 10U to the lower end 10L of the leg pad 10.

Figure 3:
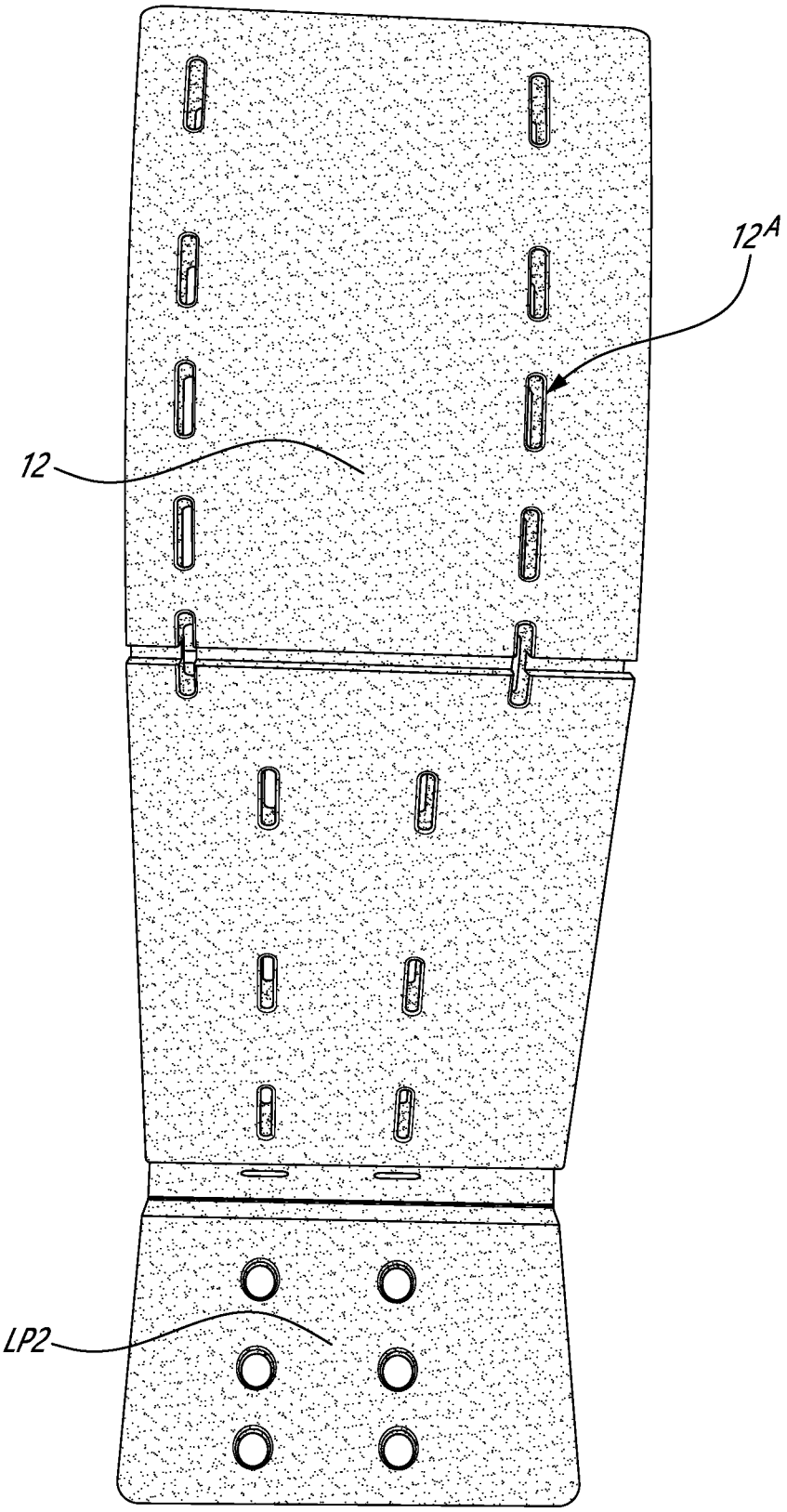
FIG. 3 is a front perspective view of a core of the hockey goalkeeper leg pad of FIG. 1.

The skin 11 covers a core 12 (shown in dotted lines in FIG. 1, and in detail in FIG. 3) of the leg pad 10. For context and orientation, in this embodiment, a lower portion (LP1) of the skin 11 (shown in FIG. 4) covers a lower portion (LP2) of the core 12 (shown in FIG. 3), and the lower portion (LP) of the core 12 is adjacent a skate (S) on a foot (F) of the leg (L) when the leg pad 10 is in use. While in this embodiment the skin 11 covers an entirety of the core 12, this may not be the case in other embodiments. In this embodiment, the core 12 is made from a shock-absorbing material, such as any conventional shock-absorbing material for example, and helps absorb at least some of the impacts that may be experienced by the front of the leg pad 10 when the leg pad 10 is in use. It is contemplated that the core 12 may have any suitable construction, such as a conventional construction for example.

Figure 2:
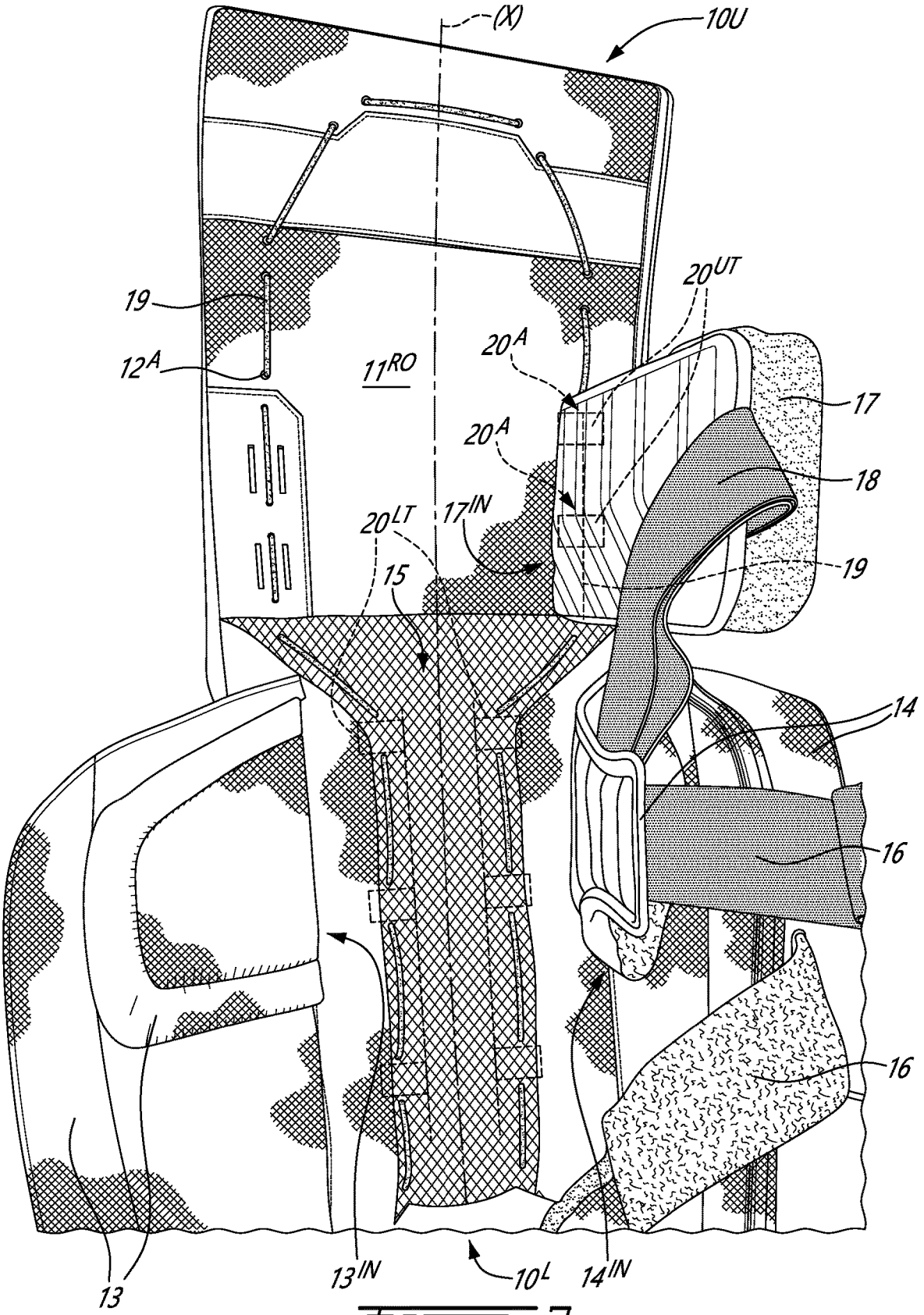
FIG. 2 is a rear perspective view of the hockey goalkeeper leg pad of FIG. 1.

Now referring to FIGS. 1 and 2, the leg pad 10 further includes two lateral leg flaps 13 that are attached to the rear outer surface 11RO of the skin 11, proximate to, and in this embodiment also generally parallel to, the lateral side (also referred to as "outward side") of the leg pad 10. It will be understood that since a left leg pad 10 is shown, the lateral side of the leg pad 10 corresponds to the left hand side of the user (U). The lateral side of a right leg pad corresponds to the right hand side of the user (U). In other embodiments, the leg pad 10 may have a different number of lateral leg flaps 13, such as a single lateral leg flap 13 or more than two lateral leg flaps 13.

Still referring to FIGS. 1 and 2, the leg pad 10 further includes two medial leg flaps 14 that are attached to the rear outer surface 11RO of the skin 11, proximate to, and in this embodiment also generally parallel to, the medial side (also referred to as "inward side") of the leg pad 10. It will be understood that since a left leg pad 10 is shown, the medial of the leg pad 10 faces toward the right leg of the user (U). The medial side of a right leg pad faces toward the left leg of the user (U). In other embodiments, the leg pad 10 may have a different number of medial leg flaps 14, such as a single medial leg flap 14 or more than two medial leg flaps 14.

The lateral and medial leg flaps 13, 14 are shaped, structured and dimensioned to protect and hold in place/secure the left and right sides of the leg (L), as well as a portion of the back of the leg (L) in this embodiment. The lateral and medial leg flaps 13, 14 define a leg channel 15 that extends in a generally vertical direction from the upper end 10U toward the lower end 10L of the leg pad 10. The leg channel 15 is shaped and dimensioned to receive the leg (L) of the user (U) therein, as shown in FIG. 1. After the leg (L)

is received in leg channel 15, calf straps 16 may be used by the user (U) to attach one or more of the medial leg flap(s) 14 to one or more of the lateral leg flaps 13, via any suitable removable connectors.

For example, in the present embodiment, one of the two calf straps 16 is attached at one end to an outer one of the medial leg flap(s) 14, via stitching for example, and the other one of the two calf straps 16 is attached at one end to an inner one of the medial leg flap(s) 14, also via stitching in this embodiment. At their other ends, the two calf straps 16 include hook-and-loop connectors used to removably attach the other ends of the calf straps 16 to corresponding ones of an outer and inner lateral leg flaps 13. These connectors may be conventional and are therefore not described in detail herein. In summary, each of the calf straps 16 is extendable across the leg channel 15 to releasably secure the leg (L) in the leg channel 15 after the leg (L) is received in the leg channel 15. It is contemplated that in other embodiments, any other suitable number, construction, and arrangement of calf straps 16 and/or other securement mechanisms may be used to releasably secure the leg (L) in the leg channel 15 after the leg (L) is received in the leg channel 15.

Still referring to FIGS. 1 and 2, the leg pad 10 further includes a knee pad 17 attached, for example via conventional stitching, to the rear outer surface 11RO of the skin 11 at a location above the medial leg flaps 14, proximate to, and in this embodiment also generally parallel to, the medial side (also referred to as "inward side") of the leg pad 10. In this embodiment, the knee pad 17 is attached along an interface 17IN between an inner edge of the knee pad 17 that faces toward and contacts the rear outer surface 11RO of the skin 11, and the rear outer surface 11RO of the skin 11. In other embodiments, any other suitable attachment may be used instead of or in addition to the stitching. The knee pad 17 is dimensioned and structured (e.g. by using and/or containing a suitable shock absorbing material) to protect the medial/inner side of the leg (L) at or above the knee. While in this embodiment the knee pad 17 is cuboid, in other embodiments other shapes and sizes may be used.

In this embodiment, a thigh strap 18 is attached to an outer edge of the knee pad 17 at one end of the thigh strap 18. The thigh strap 18 at its other end is structured using any suitable configuration and attachment, such as a hook-and-loop attachment for example, to secure the part of the leg (L) just above the knee to the knee pad 17, and hence to the leg pad 10. In an aspect, the knee pad 17 helps the user (U) to assume a "butterfly" position when acting as a hockey goaltender for example.

Referring to FIG. 2, the leg pad 10 further includes a lace 19 that in this embodiment secures the front inner surface 11FI of the skin 11, the core 12, and the rear outer surface 11RO to each other. In this embodiment, providing at least some advantages and although not necessarily being the case in other embodiments, the lace 19 is in its entirety disposed behind both the front outer surface 11FO and the front inner surface 11FI of the skin 11 so that no part of the lace 19 traverses the front outer surface 11FO. To this end, and now referring to FIG. 4, the leg pad 10 includes a lacing member 20 that extends from the lower portion (LP) of the skin 11 to an upper portion (UP) of the skin 11 and is made out of any suitable material, such as synthetic leather for example. The lacing member 20 includes a central portion 20CP attached to the front inner surface 11FI of the skin 11 and tabs 20LT, 20UT extending outward from the central portion 20CP relative to a longitudinal centerline (X) of the lacing member 20. As shown schematically with dotted lines in FIG. 2, the upper portion of the lacing member 20 is inward (toward the longitudinal centerline (X)) of the interface 17IN between the inner edge of the knee pad 17 that faces toward and contacts the rear outer surface 11RO of the skin 11. Some of the upper tabs 20UT extending from the upper portion of the lacing member 20 extend outward therefrom and are positioned under the interface 17IN of the knee pad 17. In an aspect, this alignment helps improve structural strength of the leg pad 10 in the region of the knee pad 17. In alternative embodiments, the upper portion of the lacing member 20 may be made wider so as to be positioned outward (away from the longitudinal centerline (X)) of the interface 17IN and the upper tabs 20UT corresponding to the knee pad 17 may extend inward toward the longitudinal centerline (X), and to respective points under the interface 17IN. In such alternative embodiments, the respective upper tabs 20UT are still positioned under and are aligned with the interface 17IN and may hence provide for similar structural strength of the leg pad 10.

The lacing member 20 defines a cut-out 20CO therein, and the cut-out 20CO is positioned between the upper tabs 20UT on the one side of the longitudinal centerline (X) and the upper tabs 20UT on the other side of the longitudinal centerline (X), and occupies a majority of the upper portion of the central portion 20CP. In other embodiments, multiple cut-outs 20CO may be defined through the central portion 20CP of the lacing member 20. In an aspect, the cut-out(s) 20CO help(s) simplify manufacturing and/or assembly and/or to reduce an amount of material used to make the leg pad 10. While in this embodiment the lacing member 20 is made from a single piece of material, in other embodiments this need not be the case. In some embodiments in which the lacing member 20 comprises multiple pieces of material, the pieces of material may be attached to the front inner surface 11FI of the skin 11, but need not be attached to each other. In the shown embodiment, the upper portion of the central portion 20CP of the lacing member 20 is wider than a lower portion of the central portion 20CP of the lacing member 20.

In this embodiment, the tabs 20LT, 2OUT of the lacing member 20 are attached to the front inner surface 11FI of the skin 11 at their lateral outer ends relative to the longitudinal centerline (X), via stitching 20S. Accordingly, each given tab 20LT, 20UT of the tabs 20LT, 20UT defines an aperture 20A between the given tab 20LT, 20UT and the front inner surface 11FI. The aperture 20A defined by a given tab 20LT, 20UT extends between a corresponding part of the central portion 20CP and the location of the attachment of outer end of the given tab 20LT, 20UT. While in this embodiment the tabs 20LT, 20UT terminate just outward of the attachments 20S, in other embodiments the tabs 20LT, 20UT may extend further away from the central portion 20CP past the stitching 20S. Only one corresponding pair of the stitching 20S and the aperture 20A is labeled with respect to only one of the tabs 20LT, 20UT in FIG. 2, to maintain clarity of the figure. Although stitching is used in this embodiment to secure the tabs 20LT, 2OUT of the lacing member 20 to the front inner surface 11FI of the skin, it is to be understood that other suitable attachment means may be used.

As shown schematically in FIG. 2 with respect to two of the tabs 20UT to maintain clarity of the figure, the lace 19 passes through the apertures 20A defined by each of the tabs 20LT, 20UT, the core 12, and the rear outer surface 11RO of the skin 11, via any suitable lacing pattern, such as a conventional lacing pattern. Any suitable lacing pattern may be used, and therefore lacing patterns are not described in detail herein. In extending through the core 12, the lace 19 extends through elongate apertures 12A (FIG. 3) defined through the core 12 at locations corresponding to the locations of the tabs 20LT, 20UT. In other embodiments, the lace 19 may extend through slots in the core 12 that may be open to one or more lateral sides of the core 12 for example.

The lace 19 is tightened and secured using a suitable technique and/or mechanism, and secures the front inner surface 11FI and the rear outer surface 11RO to the core 12. The tightening and securement technique and/or mechanism may be a conventional lace tightening and securement technique and/or mechanism for example, and is therefore not described in detail herein. In an aspect, the attachments 20S at the outer ends of the tabs 20LT, 20UT as described above help provide a sturdier construction of the leg pad 10, and more particularly a stronger tightening effect between the front inner surface 11FI and the core 12. That said, it is contemplated that in some embodiments, one or more of the tabs 20LT, 20UT may be unattached to the front inner surface 11FI of the skin 11 at its outer end.

Figure 4:
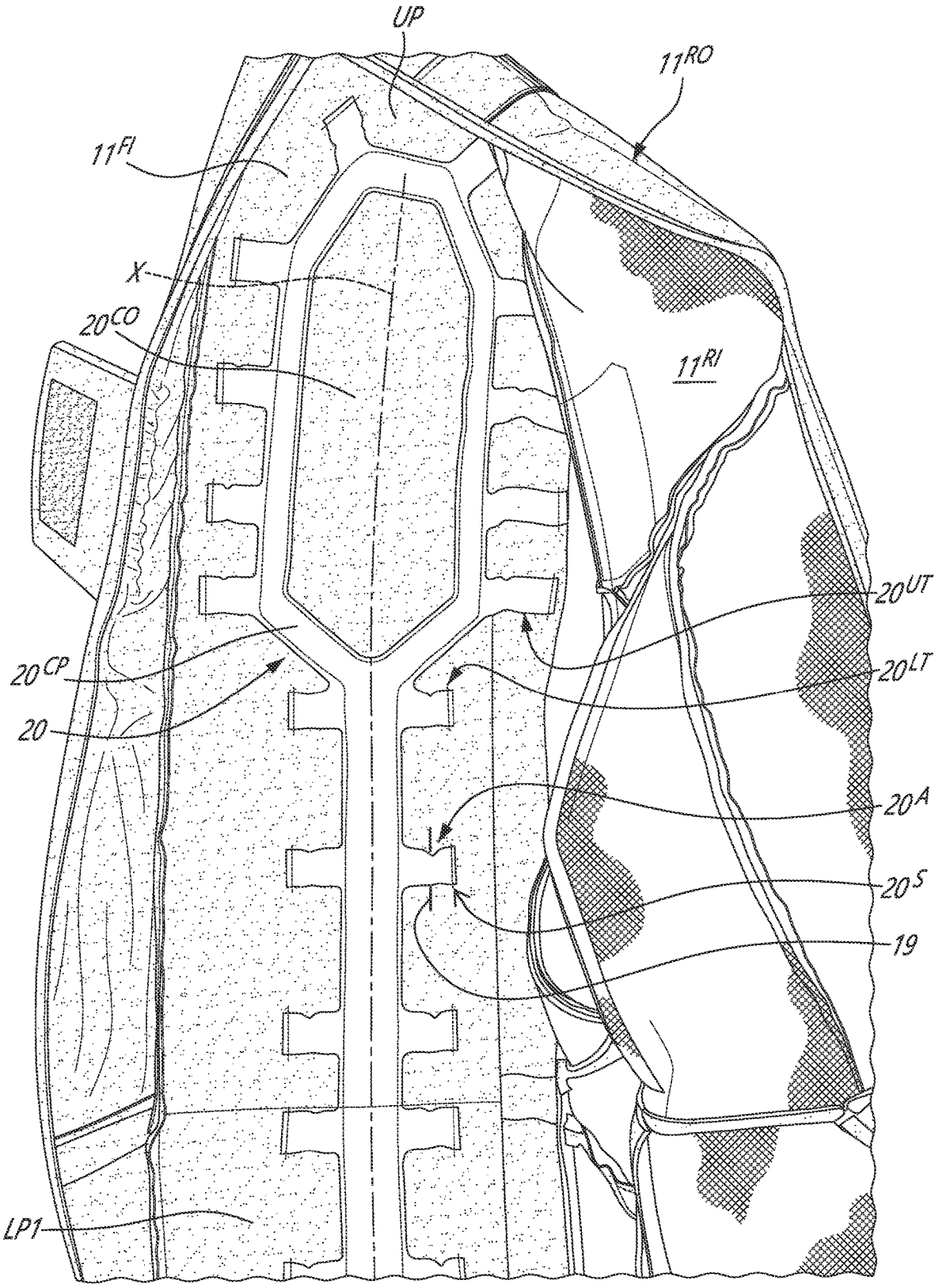
FIG. 4 is a rear perspective view of a skin of the hockey goalkeeper leg pad of FIG. 1.

Referring to FIGS. 2 and 4, in this embodiment, the tabs 20LT, 20UT include lower tabs 20LT that extend outward of a lower portion of the lacing member 20/central portion 20CP (i.e. the half that is closer to the skate (S) and that extends toward the lower end 10L of the leg pad 10), and upper tabs 20UT that extend outward of an upper portion of the lacing member 20/central portion 20CP. Only some of the tabs 20LT, 20UT are shown, in dotted lines, and labeled in FIG. 2, to maintain clarity.

As shown, in this embodiment, the upper tabs 20UT are offset outward of and extend outward of all of the lower tabs 20LT relative to the longitudinal centerline (X) of the lacing member 20. Also as shown, in this embodiment, the upper tabs 20UT include upper tabs 20UT on each side of the longitudinal centerline (X). Although the outward offset and extension help provide a sturdier and in at least some embodiments easier assembly of the leg pad 10, in some embodiments, not all of the upper tabs 20UT may be offset and/or may extend outward of all of the lower tabs 20LT.

As shown schematically in FIG. 4 with respect to one of the upper tabs 20UT to maintain clarity of the figure, in the present embodiment, the lace 19 extends between each of the tabs 20LT, 20UT and the front inner surface 11FI of the skin 11, and through the core 12, to secure the core 12 to the lacing member 20. More particularly, in this embodiment, the lace 19 passes through the apertures 20A between the tabs 20LT, 20UT and the front inner surface 11FI of the skin 11 as described above.

Stated otherwise, and although this need not be the case in other embodiments, each of the tabs 20LT, 20UT is attached to the front inner surface 11FI of the skin 11 outward the corresponding part of the lace 19, relative to the longitudinal centerline (X). The apertures 12A in the core 12 and the lace 19 are positioned such that a corresponding part of the lace 19 passes at least proximate to, and in this embodiment aligns with and passes through and in parallel to, the interface 17IN between the inner edge of the knee pad 17 that faces toward and contacts the rear outer surface 11RO of the skin 11. Accordingly, the corresponding ones of the upper tabs 20UT are positioned to extend over the part of the lace 19 corresponding to the interface 17IN. This construction helps facilitate assembly and structural strength of the leg pad 10 in at least some embodiments of the leg pad 10.

Also, since in this embodiment the upper tabs 20UT are outwardly offset relative to the lower tabs 20LT as described above, the attachments 20S of the upper tabs 20UT to the front inner surface 11FI of the skin 11 are disposed outward of the attachments 20S of the lower tabs 20LT to the front inner surface 11FI of the skin 11, relative to the longitudinal centerline (X). While helping to provide a sturdier construction of the leg pad 10, in other embodiments not all of the upper attachments 20S may be laterally outwardly offset from all of the lower attachments 20S.

While in this embodiment the lace 19 extending through the lower tabs 20LT and the lace 19 extending through the upper tabs 20UT are one and the same lace 19, this need not be the case. In some embodiments, multiple laces may be used to provide for the function of the lace 19. For example, one lace may pass through the upper tabs 20UT, the core 12, and the rear outer surface 11RO, while not passing through any of the lower tabs 20LT, and another lace may pass through the lower tabs 20LT, the core 12, and the rear outer surface 11RO, while not passing through any of the upper tabs 20UT. It is contemplated that the lace(s) 19 may be conventional lace(s) 19.

In this embodiment, as shown schematically in FIG. 2, some upper tabs 20UT are disposed behind the interface 17IN between the knee pad 17 and the rear outer surface 11RO of the skin 11, such that a corresponding part of the lace 19 aligns with and passes through the interface 17IN as described above. Also in this embodiment, and also as shown schematically in FIG. 2, these upper tabs 20UT are thus aligned with the interface 17IN such that the corresponding part of the lace 19 passing through these upper tabs 20UT are generally parallel to the interface 17IN and are disposed along the inner edge of the knee pad 17 that defines the interface 17IN.

In this embodiment the corresponding parts of the lace 19 are disposed between the rear outer surface 11RO of the skin 11 and the knee pad 17 and pass through the interface 17IN and parts of the knee pad 17 defining the interface 17IN. In use, the lace 19 is tightened and thereby attaches the knee pad 17 to the rear outer surface 11RO of the skin 11 and the core 12. The construction and arrangement described above help provide a sturdier construction of the leg pad 10. More particularly, the construction helps provide a tighter securement between the knee pad 17, the core 12 and the corresponding part of the skin 11 to which the knee pad 17 is attached. The knee pad 17 being a structural element that may be typically subjected to relatively large forces during use of the leg pad 10, it needs to be solidly affixed to the rear outer surface 11RO of the skin 11 and the core 12. In an aspect, it has been found that using the same mechanism to attach the knee pad 17 that attaches the skin 11 to the core 12 (in this embodiment, the lace 19) is more efficient in at least some embodiments, and may help provide a sturdier construction, than having a separate attachment mechanism for the knee pad 17.

Still referring to and as shown in FIG. 2, in this embodiment, at least some parts of the lace 19 that pass through the apertures 20A defined by the upper tabs 20UT, pass through the rear outer surface 11RO at locations that may be optionally aligned with and may be disposed above an interface 13N between at least one of the lateral leg flap 13 and the rear outer surface 11RO. These parts of the lace 19 may also pass through the rear outer surface 11RO at locations that are aligned with and are disposed above an interface 141N between at least one of the medial leg flaps 14 and the rear outer surface 11RO. These parts of the lace 19 are provided sufficiently wide on the rear outer surface 11RO to help provide a sturdier attachment of the upper part of the core 12 to the respective part of the skin 11. While this arrangement helps provide a sturdier construction of the leg pad 10, in other embodiments a different arrangement of this part of the lace 19 may be used. For example, in some embodiments, this part of the lace 19 may be laterally outward of the interface(s) 13IN of the lateral leg flap(s) 13, or slightly inward thereof.

Also in this embodiment, at least some of the parts of the lace 19 that pass through the apertures 20A defined by the lower tabs 20LT, pass through the rear outer surface 11RO at locations that are inward of both the lateral leg flaps 13 and the medial leg flaps 14. In an aspect, this inward positioning of this part of the lace 19 helps provide a better fit of the leg pad 10 around the calf area of the leg (L) by helping create a smaller leg channel 15 and allowing the lateral leg flaps 13 to better wrap the rear outer surface 11RO of the leg pad 10 around the leg.

The leg pad 10 described herein may be made from any suitable combination of materials, such as conventional materials for example, and using any suitable manufacturing and assembly methods, such as conventional manufacturing and assembly methods. A leg pad for a right leg of a user (US) may be made by making a mirror image of the leg pad 10 described above. A set of left and right leg pads 10 may be manufactured to fit one or more given leg and/or user sizes.

The above description is meant to be exemplary only, and one skilled in the art will recognize that changes may be made to the embodiments described without departing from the scope of the technology disclosed herein. For example, while in this embodiment, the lace 19 extends through the rear outer surface 11RO of the skin 11, in other embodiments this need not be the case. For example, in some embodiments, a lacing member similar to the lacing member 20 may be attached to the rear inner surface 11RI and the lace 19 may extend through apertures of that lacing member for example.

The invention claimed is:

1. A hockey goalkeeper leg pad, comprising:

a core having core apertures extending therethrough;

a skin covering the core at least in part and having a front outer surface, a front inner surface, and a rear outer surface;

a lateral leg flap and a medial leg flap attached to the rear outer surface of the skin and defining a leg channel between the lateral and medial leg flaps;

a lacing member attached to the front inner surface and defining a longitudinal centerline, the lacing member including:

a central portion attached to the front inner surface, a lower portion of the lacing member including lower tabs extending outward of the central portion relative to the longitudinal centerline, the lower tabs defining lower apertures with the front inner surface, the lower tabs being attached to a lower portion of the front inner surface at lateral outer ends of the lower tabs, the lateral outer ends of the lower tabs being spaced apart from the longitudinal centerline by a first distance, and an upper portion of the lacing member including upper tabs extending outward of the central portion relative to the longitudinal centerline, the upper tabs defining upper apertures with the front inner surface, the upper tabs being attached to an upper portion of the front inner surface at lateral outer ends of the upper tabs, the lateral outer ends of the upper tabs being spaced apart from the longitudinal centerline by a second distance greater than the first distance, such that the upper tabs are laterally offset outward of the lower tabs relative to the longitudinal centerline and the upper portion of the lacing member has a greater lateral width than the lower portion of the lacing member on the front inner surface; and a lace extending through the lower apertures and the upper apertures and through the core to secure the core to the lacing member, wherein the lace is configured to be tightened without causing the lower tabs and the upper tabs of the lacing member to be pulled through the core apertures of the core;

wherein the lateral outer ends of each of the lower tabs is attached to the front inner surface of the skin at a location that is outward of a part of the lace passing through the aperture defined by that lower tab, relative to the longitudinal centerline of the lacing member; and the lateral outer ends of each of the upper tabs is attached to the front inner surface of the skin at a location that is outward of a part of the lace passing through the aperture defined by that upper tab, relative to the longitudinal centerline of the lacing member.

2. The hockey goalkeeper leg pad of claim 1, further comprising a strap extendable across the leg channel to releasably secure a leg in the leg channel after the leg is received in the leg channel, wherein: the lower tabs extend outward of a lower portion of the lacing member and the upper tabs extend outward of an upper portion of the lacing member.

3. The hockey goalkeeper leg pad of claim 1, wherein the upper tabs include upper tabs on each side of the longitudinal centerline.

4. The hockey goalkeeper leg pad of claim 3, wherein the lacing member defines a cut-out therein, and the cut-out is positioned between the upper tabs on one side of the longitudinal centerline and the upper tabs on the other side of the longitudinal centerline.

5. The hockey goalkeeper leg pad of claim 4, wherein the lacing member extends from a lower portion of the skin to an upper portion of the skin.

6. The hockey goalkeeper leg pad of claim 5, wherein the lower portion of the skin covers a lower portion of the core, and the lower portion of the core is adjacent a skate on a foot of a leg secured in the leg channel when the hockey goalkeeper leg pad is in use.

7. The hockey goalkeeper leg pad of claim 1, further comprising a knee pad disposed on the rear outer surface above the medial leg flap, the knee pad being attached to the rear outer surface by the lace extending through the upper apertures.

8. The hockey goalkeeper leg pad of claim 7, wherein one or more of the upper tabs are disposed behind an interface between the knee pad and the rear outer surface and at least a portion of the lace passing through the one or more the upper tabs are parallel to the interface.

9. The hockey goalkeeper leg pad of claim 8, wherein the at least a portion of the lace passes through a part of the knee pad to attach the knee pad to the skin and the core when the lace is tightened when the hockey goalkeeper leg pad is assembled.

10. The hockey goalkeeper leg pad of claim 9, wherein the lace:

passes through the rear outer surface of the skin at locations that are inward of the lateral leg flap and the medial leg flap, and secures both upper and lower portions of the rear outer surface of the skin to respective upper and lower portions of the core.

11. The hockey goalkeeper leg pad of claim 10, wherein the lace passes through the rear outer surface of the skin at locations that are aligned with an interface between the lateral leg flap and the rear outer surface, and at locations that are aligned with an interface between the medial leg flap and the rear outer surface.

12. The hockey goalkeeper leg pad of claim 10, wherein the lace is in its entirety disposed behind the front outer surface and the front inner surface of the skin.

13. The hockey goalkeeper leg pad of claim 1, wherein the lace includes a first lace passing through the upper tabs and through the core and a second lace passing through the lower tabs and through the core.

14. The hockey goalkeeper leg pad of claim 1, wherein an upper portion of the central portion of the lacing member is wider than a lower portion of the central portion of the lacing member.

15. A hockey goalkeeper leg pad, comprising:

a core having core apertures extending therethrough;

a skin covering the core at least in part and having a front outer surface, a front inner surface, and a rear outer surface;

a lateral leg flap and a medial leg flap attached to the rear outer surface of the skin and defining a leg channel between the lateral leg flap and the medial leg flap;

a lacing member including a central portion attached to the front inner surface and tabs extending outward of the central portion relative to a longitudinal centerline of the lacing member, the tabs attached to the front inner surface at lateral outer ends thereof, the tabs and the front inner surface of the skin defining apertures between the tabs and the front inner surface, wherein the tabs include:

lower tabs extending outward of a lower portion of the central portion of the lacing member relative to the longitudinal centerline, the lower tabs having lateral outer ends that are spaced apart from the longitudinal centerline by a first distance, upper tabs extending outward of an upper portion of the central portion of the lacing member relative to the longitudinal centerline, the upper tabs extending laterally outward of the lower tabs relative to the longitudinal centerline of the lacing member, the upper tabs having lateral outer ends that are spaced apart from the longitudinal centerline by a second distance greater than the first distance such that the upper tabs are laterally offset outward of the lower tabs relative to the longitudinal centerline; and a lace extending through the apertures of the tabs, the apertures of the core, and securing the front inner surface to the core without causing the tabs to be pulled through the core apertures;

wherein the tabs are attached to the front inner surface of the skin at locations that are laterally outward of the corresponding parts of the lace relative to the longitudinal centerline of the lacing member.

16. The hockey goalkeeper leg pad of claim 15, wherein the lacing member extends from a lower portion of the skin to an upper portion of the skin and the central portion of the lacing member defines a cut-out therein.

17. The hockey goalkeeper leg pad of claim 16, further comprising a knee pad attached to the rear outer surface of the skin by the lace at a location above the medial leg flap.

18. The hockey goalkeeper leg pad of claim 17, wherein one or more of the upper tabs are disposed behind an interface between the knee pad and the rear outer surface, and a portion of the lace passes through the one or more of the upper tabs, the interface, and the knee pad, to attach an inner edge of the knee pad to the rear outer surface of the skin.

19. The hockey goalkeeper leg pad of claim 18, wherein the lace:

attaches the knee pad to both the skin and the core, attaches both the front inner surface and a rear inner surface of the skin to the core, and is in its entirety disposed behind both the front outer surface and the front inner surface of the skin.

20. The hockey goalkeeper leg pad of claim 15, wherein an upper portion of the central portion of the lacing member is wider than a lower portion of the central portion of the lacing member.

21. The hockey goalkeeper leg pad of claim 15, further comprising a strap extendable across the leg channel, the strap being configured to releasably secure a leg in the leg channel after the leg is received in the leg channel.

22. The hockey goalkeeper leg pad of claim 15, wherein the upper tabs include upper tabs on each side of the longitudinal centerline.

23. The hockey goalkeeper leg pad of claim 15, wherein the lace includes a first lace passing through the upper tabs and through the core and a second lace passing through the lower tabs and through the core.

24. The hockey goalkeeper leg pad of claim 16, wherein the cut-out is positioned between upper tabs on one side of the longitudinal centerline and upper tabs on the other side of the longitudinal centerline.

* * * * *